United States Patent [19]

Young et al.

[11] Patent Number: 4,960,204

[45] Date of Patent: Oct. 2, 1990

[54] CARRY-ON TRAVEL BAG FOR COSMETICS

[76] Inventors: Ilsa A. Young, 6380 Snowbird Dr., Colorado Springs, Colo. 80918; Doris K. Roberts, 10 Woodmen La., Colorado Springs, Colo. 80919

[21] Appl. No.: 239,772

[22] Filed: Sep. 2, 1988

[51] Int. Cl.[5] ..... A45D 33/00; A45D 43/00; A45D 44/18; A45C 13/00

[52] U.S. Cl. ..... 206/235; 206/37; 206/38; 190/109; 190/111; 383/38; 383/39

[58] Field of Search ..... 206/37, 38, 235; 190/107, 109, 110, 111; 383/38, 39; 132/314, 315

[56] References Cited

U.S. PATENT DOCUMENTS

| | | | |
|---|---|---|---|
| 1,495,220 | 5/1924 | Carroll | 383/39 |
| 1,705,149 | 3/1929 | Brady | 190/111 |
| 1,742,867 | 1/1930 | Levi | 190/116 X |
| 1,908,714 | 11/1934 | Brady | 190/109 |
| 2,107,180 | 2/1938 | Gihon, 3rd | 190/110 |
| 2,359,372 | 10/1944 | Leader | 383/39 |
| 2,631,632 | 3/1953 | Leachman | 190/109 |
| 3,139,133 | 6/1964 | Spector | 383/39 X |
| 3,929,224 | 12/1975 | Smith, Jr. | 383/39 X |
| 4,461,332 | 7/1984 | Parkhurst | 206/235 X |
| 4,569,082 | 2/1986 | Ainsworth et al. | 190/107 X |
| 4,753,329 | 6/1988 | Choy | 190/111 |
| 4,859,084 | 8/1989 | Kaumeyer | 383/39 |

FOREIGN PATENT DOCUMENTS

| | | | |
|---|---|---|---|
| 117830 | 11/1943 | Australia | 190/119 |
| 8702227 | 4/1987 | PCT Int'l Appl. | 190/110 |
| 270097 | 5/1927 | United Kingdom | 190/111 |
| 668742 | 3/1952 | United Kingdom | 190/109 |

*Primary Examiner*—Sue A. Weaver
*Attorney, Agent, or Firm*—Klaas & Law

[57] ABSTRACT

A softside travel bag for cosmetics having a plurality of separate individual inside compartments and which is foldable for carrying and storage and is hangable in an open vertical position whereat personal care items may be removably stored.

18 Claims, 3 Drawing Sheets

CARRY-ON TRAVEL BAG FOR COSMETICS

BACKGROUND OF THE INVENTION

This invention relates to a carry-on travel bag for cosmetics, hair grooming appliances and personal effects.

The problems associated with travel of women with cosmetics and personal effects are legend. Oftentimes, such items are merely carried in conventional luggage in random fashion with a hope and prayer for safe arrival. For many years, relatively small-size, hardside cosmetic cases have been used which have an upper pivotal lid, an inside tray, and a main central storage compartment. Upon arrival at a destination away from home, such as a hotel, such items are often removed from the luggage and placed on all available flat space such as bathroom counters and dresser tops. Often such items are bounced, bashed and broken during handling and storage of luggage by airline personnel. Certainly few circumstances are more dismaying than to watch a hardside cosmetic case open unexpectedly. Such cosmetic cases have often been seen to come tumbling down a luggage conveyor in an airport and then open to spill the contents on the conveyor. In addition, women often have need for cosmetics and personal items while on board an airplane or during travel when regular luggage containing such items may be unavailable.

A primary object of the present invention is to provide a general solution to problems related to storage, transportation and use of cosmetics, medicines, personal hygiene items, and the like, for women.

At the present time, travelers frequently use various types of carry-on luggage, such as garment carriers, in order to arrive at their destination with wrinkle-free clothes, and to avoid the time consuming delays of checking and picking up checked luggage. The proliferation of passengers with carry-on luggage has led the airlines to provide closets for hanging garment carriers and closable overhead compartments suitable for storage of various types of carry-on items. These storage spaces, however, are often inadequate to hold all the carry-on articles passengers are likely to have. Specifically, passengers who are among the last people to board may find all the closets and overhead compartments filled, leaving only the option of storing carry-on items under the seat in front of the passenger or checking the items with the flight attendants. The airlines have adopted rules and regulations requiring that carry-on luggage be of a specified minimum size such as to fit under the seat. Many attempts have been made to combine a garment carrier with other carrying cases, such as described in Shapiro, U.S. Pat. No. 4,206,835 and Ekeson U.S. Pat. No. 3,729,038; and to provide a garment carrier that is convenient to carry, such as Tabor et al. U.S. Pat. No. 4,062,429 and Rosenblum U.S. Pat. No. 3,958,675; and various other combinations such as Komroff U.S. Pat. No. 3,291,266; Foge U.S. Pat. No. 3,917,038 and Lane et al. U.S. Pat. No. 4,655,343.

Another object of the present invention is to provide a cosmetic bag for women which can also be carried on an aircraft and can be stored under an airplane seat when necessary.

BRIEF SUMMARY OF THE INVENTION

The present invention provides a flexible, softside travel bag for holding cosmetics and accessories while hanging in a vertical, fully-extended, open position and in a closed, folded, carrying and storage position.

The travel bag includes openable and closeable, separate, individual pocket means for various personal care items for women, such as mirrors; appliances, such as hair combs, brushes, blow drier and curling iron, etc.; hairpins, clips and curlers; feminine hygiene products, such as sanitary napkins and douche packages; cottonballs an Q-tips; containers for medicines such as prescription drugs, aspirin and the like; facial cosmetic containers, jars, tubes, pencils and brushes; containers of body lotions, hair care conditioners, powder, cleanser, toner, eye makeup; a sewing kit; nail polish containers, cutters and files; and the like.

The cosmetic bag of the present invention is constructed and arranged to enable the bag to be hung in a vertical, open position with the opening of all pocket means facing upwardly to prevent the contents from falling out. The pocket means are preferably made of transparent, plastic, waterproof material to enable the contents to be viewed and to prevent materials, such as powders or liquids, from leaking into the main compartment area. At least some, and preferably all, of the pocket means are provided with openable and closeable closure means to prevent accidental discharge of the contents.

The present invention is preferably constructed and arranged to meet all airline requirements for carry-on luggage and include accessory pockets and attachments for convenient carrying and storage in an overhead compartment or storage under an airline seat.

BRIEF DESCRIPTION OF DRAWING

An illustrative and presently preferred embodiment of the invention is shown in the accompanying drawings wherein.

DETAILED DESCRIPTION

Figure 1:
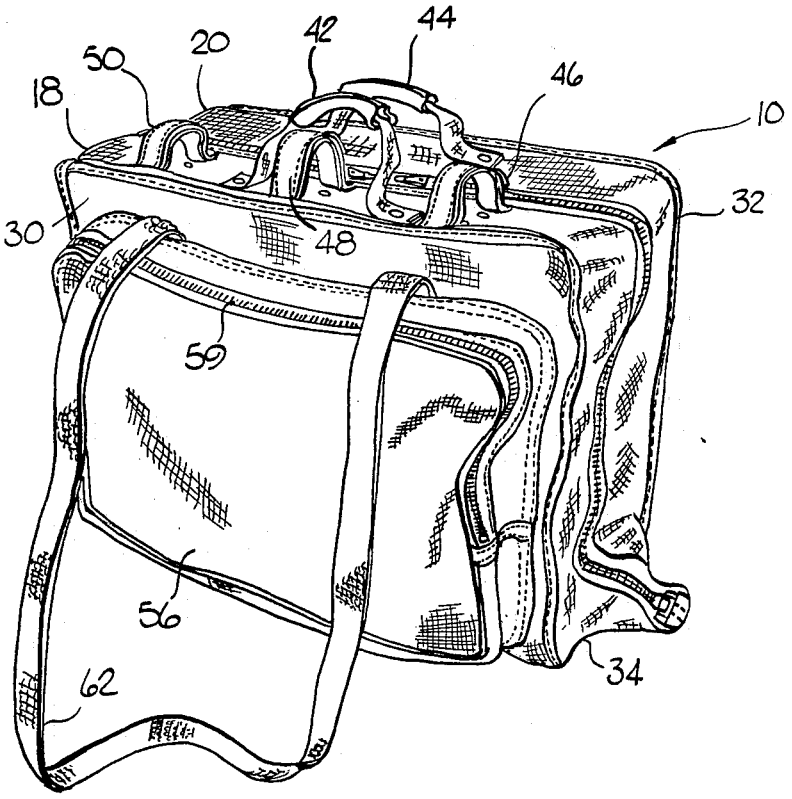
FIG. 1 is a first perspective view of the bag in a folded, closed position.
Figure 2:
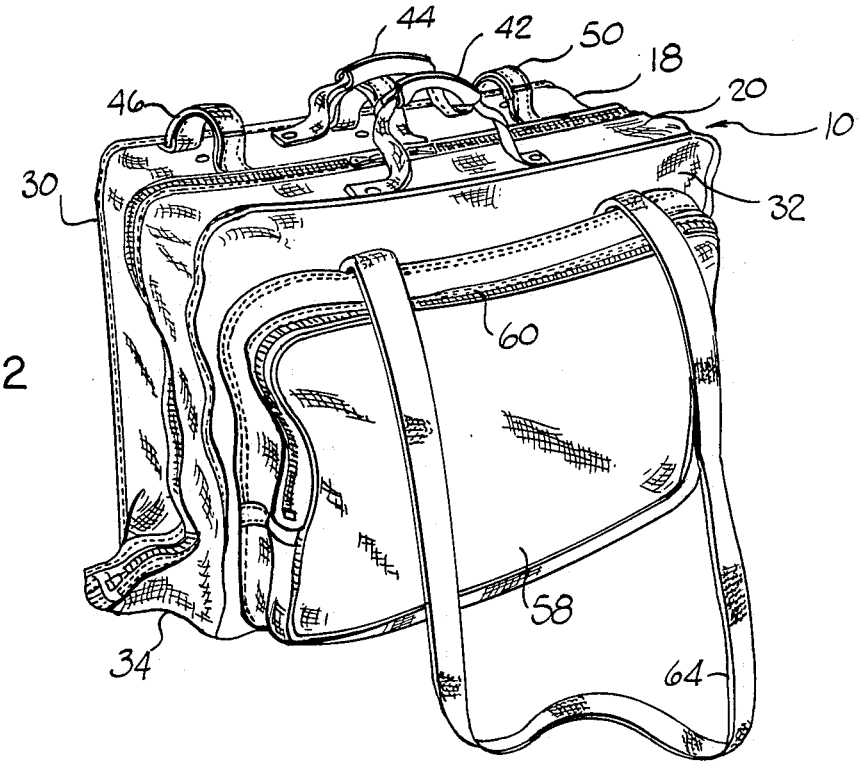
FIG. 2 is a second perspective view of the bag in the folded, closed position.
Figure 3:
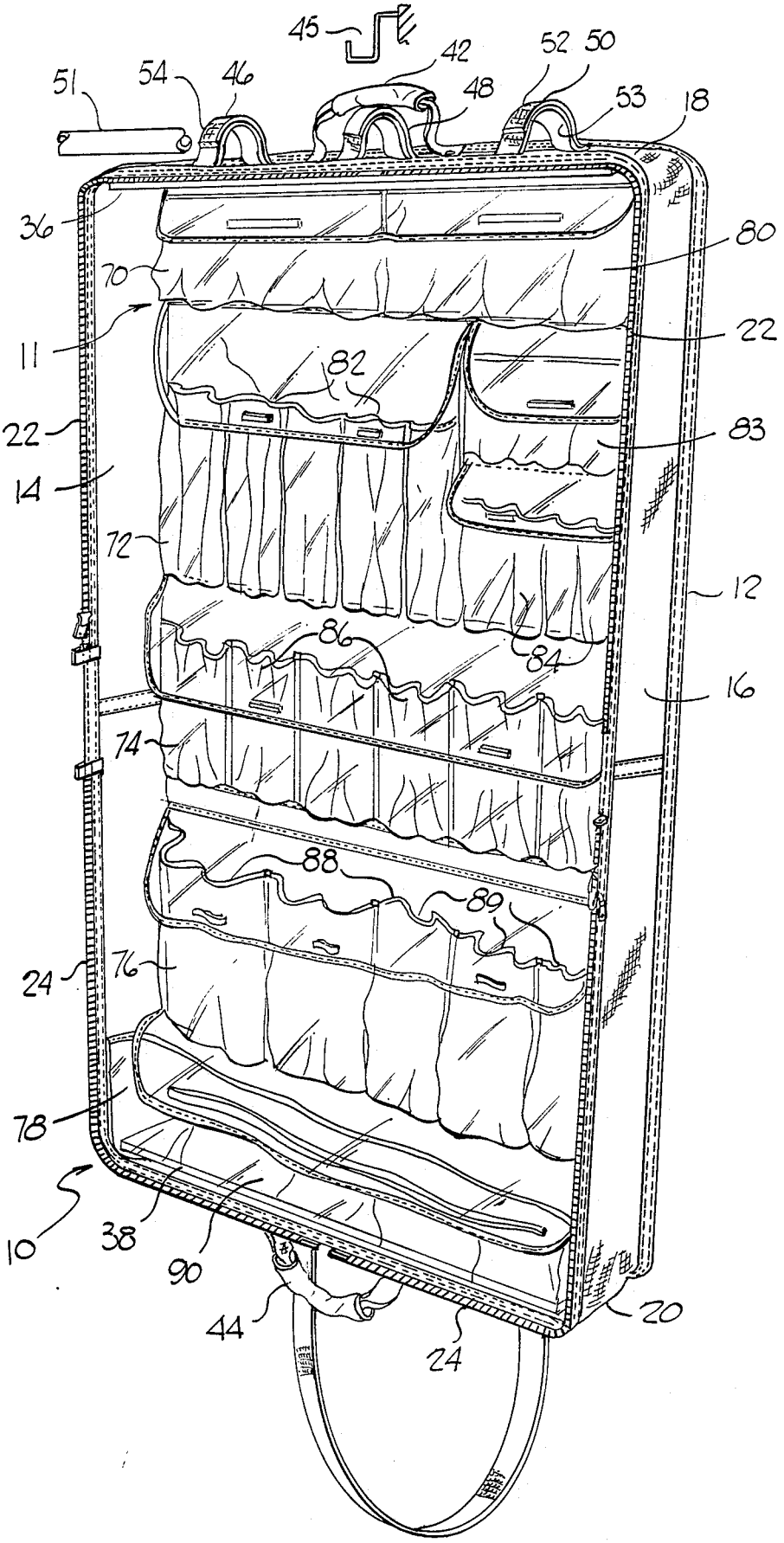
FIG. 3 is a perspective view of the bag in an open, hanging position.

In general, as shown in FIGS. 1–3, the present invention provides a flexible, softside travel bag which may be used for carrying, storage and transportation of the contents in a closed, folded position (FIGS. 1 & 2) and which may be hung in a vertical open position (FIG. 3) to enable ready access to the inside of the bag. The bag comprises a box-like, flexible, foldable, exterior shell means portion 10 providing a main storage compartment therewithin and a flexible, foldable, interior, multiple compartment means portion 11 (FIG. 3).

The bag exterior shell portion 10 is preferably made from one or more pieces of soft pliable material such as canvas, cloth or plastic having a rectangular back wall portion 12 and side wall portions 14, 16, 18, 20, FIG. 3. A pair of U-shape zipper means 22, 24 are provided along side wall portions 14, 18, 16 and 14, 20, 16, respectively, to enable the bag to be closed in the folded position of FIGS. 1 & 2.

In the folded position, back wall portion 12 provides opposite equal-size vertical side wall portions 30, 32 and a central horizontal bottom wall portion 34. End wall portions 18, 20 are located adjacent one another to provide an upper horizontal side wall. Rectangular reinforcement panel members 36, 38, (FIG. 3) and 40 (FIG. 5), made of a suitable material such as plastic, are fixedly mounted on and extend across end wall portions 18, 20 and center bottom wall portion 34.

Handle means 42, 44 are provided on end wall portions 18, 20 for carrying the bag in the folded position and enabling the bag to be hung by handle means 42 in the open vertical position on a support hook 45 or the like. Loop means 46, 48, 50 are provided on end wall portion 18 to enable the bag also to be hung from a towel rod 51, shower curtain rod or the like in the vertical open position, FIG. 3. Each of the loop means preferably comprise a pair of overlapping strap portions 52, 53 which are openable and closeable and connectable by fastener devices 54, such as snaps or Velcro. Exterior bag portion 10 preferably is provided with outside pocket means 56, 58 with zipper devices 59, 60 on side wall portions 30, 32. Shoulder strap means 62, 64 are provided on side wall portions to enable the bag to be carried in the closed position or hung from support hook 45 in the open position.

Figure 4:
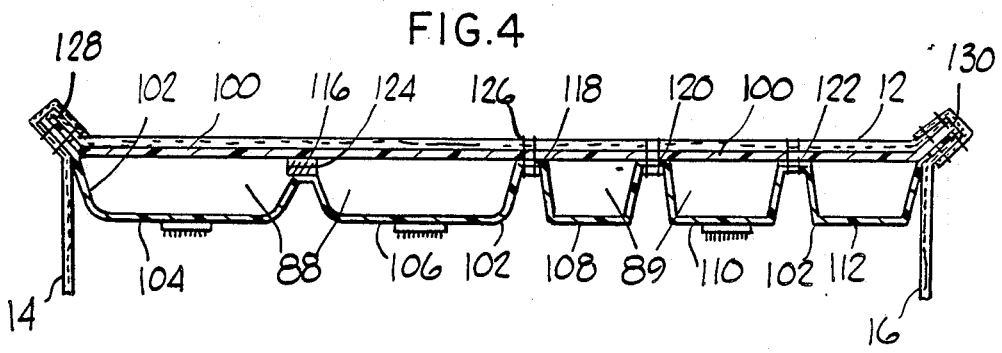
FIG. 4 is a cross-sectional view of an illustrative pocket means and bag.
Figure 5:
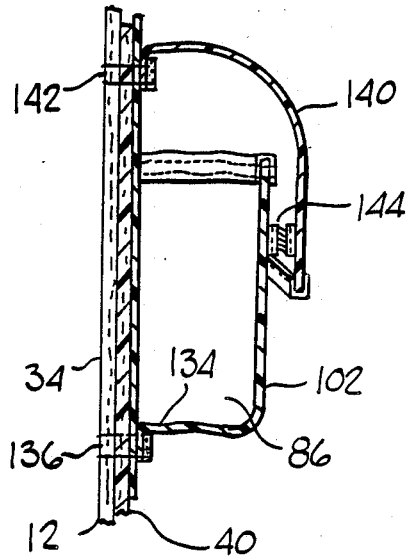
FIG. 5 is a vertical cross-sectional view of an illustrative pocket means, flap means and the bag.

In general, as shown in FIGS. 3–5, the flexible foldable interior multiple compartment means 11 comprises a plurality of laterally-spaced, individual, separate pocket means for holding various types of personal care-type items, such as cosmetics, hair grooming apparatus such as combs, brushes, hair driers, etc., containers for lotions and shampoo or the like, curlers, hairpins, medicines, and feminine hygiene products, such as sanitary napkins. In the preferred embodiment, each of the individual pocket means have vertically upwardly facing openings and associate closure flap means with fastener means, such as Velcro strips, to prevent discharge of pocket contents when the bag is in the folded carrying position of FIGS. 1 & 2.

In the preferred embodiment, various size and shape pocket means are provided to accommodate various kinds and types of personal care items and arranged in vertically spaced rows 70, 72, 74, 76, 78. The top row 70 of pockets comprises two relatively large-size horizontally elongated pockets 80 The next row 72 comprises five relatively large-side vertically elongated pockets 82, a relatively small-size horizontally elongated upper pocket 83 and a pair of relatively small-size lower vertically elongated pockets 84. Row 74 comprises six medium-size pockets 86. Row 76 comprises two relatively large-size vertically elongated pockets 88 and three smaller vertically elongated pockets 89. Row 78 comprises one relatively large-size horizontally elongated pocket 9 for appliances.

In the presently preferred embodiment, as shown in FIGS. 4 & 5, compartment means 11 comprises a one-piece rectangular backing sheet 100 of plastic material such as 12 guage vinyl of approximately the same peripheral size and shape as back panel portion 12; a plurality of continuous elongated transversely extending rectangular strips 102 of clear plastic material such as 8 guage vinyl which are fixedly mounted on backing sheet 100 to form the pockets. Pockets 80, 82, 84, 86 & 88 are formed by separate individual pleated strips 102. As shown in FIG. 4, pockets 88 & 89 are formed by individual pocket portions 104, 106, 108, 110, 112 separated by attachment strip portions 116, 118, 120, 122 fastened to the backing sheet 100 by stitching or heat sealing indicated at 124, 126. The strip end portions 128, 130 are fixedly attached to sheet 100 and wall portions 12, 14, 16. The bottom wall portions 132, FIG. 5, of each pocket portion may be formed by a rearwardly folded portion 134 of strip 102 which is stitched or heat-sealed to backing sheet 100 as indicated at 136. Each of the pocket flaps 140 are formed from one piece of vinyl plastic material which is stitched or heat-sealed to backing sheet 100 as indicated at 142, FIG. 5, and are connectable to the pockets by Velcro fastener devices 144.

In the preferred embodiment, each of the groups of pockets 80, 82, 83, 84, 86; 88 and 89 and 90 are covered by a single separate flap. Preferably, the pocket means assembly 11 is separately manufactured and then the backing sheet 100 of the sub-assembly is stitched or otherwise suitable fastened to the back panel portion 12 of the bag as indicated at 126, 128, 130.

In the presently preferred embodiment, the pockets are sized and shaped for particular items such as eye make-up and medicines for pockets 80; make-up brushes, make-up, cleanser and toner containers for pockets 82; cottonballs and Q-tips for pocket 83; nail polish containers for pockets 84; hair care, body care, shampoo, hair conditioner and powder containers for pockets 86; mirrors, hair clips and rollers for pockets 88; and appliances such as hair brushes, blowers, curling irons, etc. for pocket 90.

It is contemplated that the inventive concepts herein described may be variously otherwise embodied and thus, it is intended that the appended claims be construed to include alternative embodiments of the invention, except insofar as limited by the prior art.

What is claimed is:

1. A flexible travel bag for holding personal care items such as cosmetics and accessories while hanging in a vertical fully extended open position and in a closed folded carrying and storage position comprising:

a relatively large size main storage compartment means made of flexible foldable material and having a generally rectangular peripheral configuration and having a main flat outer side wall portion, an upper peripheral outer wall portion, a pair of spaced peripheral outer side wall portions and a bottom peripheral outer wall portion defining a main storage compartment;

a main compartment closure means mounted along said upper peripheral outer wall portion and along said spaced peripheral outer side wall portions of said main storage compartment means and along said bottom peripheral outer wall portion for closing said main storage compartment means in said closed, folded position while enabling movement between said open position and said closed folded position;

hanger means mounted along said upper peripheral outer wall portion for hanging the bag in the vertical fully extended open position;

a plurality of relatively small size generally rectangular separate secondary storage compartment means mounted in said main storage compartment means for holding and storing a plurality of different types of relatively small size items, each secondary storage compartment means having a back wall portion, a front wall portion, a pair of laterally spaced closed side portions, a closed lower side portion and an opening on the upper side portion which faces upwardly in said vertical fully extended open position;

said secondary storage compartment means having a plurality of different sizes and shapes and being arranged in a plurality of vertically spaced rows extending laterally across said main flat side wall portion between said pair of spaced peripheral outer side wall portions;

cover means for selectively covering and uncovering the open upper side portion of said relatively small size secondary storage compartment means and being movable between an open access position and a closed position relative to said secondary storage compartment means;

handle-type carrying means for carrying said bag by hand in the folded carrying and storage position and being fixed to said main storage compartment means and being positioned and located along said upper peripheral outer wall portion in the folded carrying and storage position;

and wherein said secondary storage compartment means comprising:

a main support sheet of plastic material fastened to said main flat outer side wall portion and having a length and width approximately equal to the length and width of said main flat outer side wall portion and forming said back wall portion of each of said secondary storage compartment means; and a plurality of separate sheets of plastic material fastened to said main support sheet of plastic material extending laterally thereacross and having a length equal to the width of said main support sheet of plastic material and a width equal to the height of said secondary storage compartment means and forming said front wall portion and said side portions and said lower side portion of each of said secondary storage compartment means.

2. The invention as defined in claim 1 and wherein said hanging means comprising:

strap means for engagement with a shower rod or hook.

3. The invention as defined in claim 1 and further comprising:

another separate sheet of plastic material fastened to said main support sheet of plastic material and forming each of said cover means.

4. The invention as defined in claims 1 or 3 and further comprising:

fastening means associated with said cover means for fastening said cover means to said secondary storage compartment means.

5. The invention as defined in claim 1 and wherein said secondary storage compartment means further comprising:

a first uppermost row of two equal size and shape horizontally elongated compartments extending between said outer side wall portions;

a second row of more than two vertically elongated equal size and shape compartments located next below said first row and extending between said outer side wall portions;

a third row of more than two vertically elongated equal size and shape compartments located next below said second row at the mid-section of said bag and extending between said outer side wall portions;

a fourth row of more than two equal size and shape vertically elongated compartments located next below said third row and extending between said outer side wall portions; and an elongated bottom compartment located above said bottom outer wall portion and extending between said outer side wall portions.

6. The invention as defined in claim 1 and wherein said secondary storage compartment means comprising:

at least one row of at least two horizontally elongated compartments; and at least two rows of more than two vertically elongated compartments.

7. The invention as defined in claim 6 and wherein the compartments in each row of vertically elongated compartments are of the same size and shape.

8. The invention as defined in claim 6 and wherein the compartments in different rows of vertically elongated compartments are of different sizes and shapes.

9. The invention as defined in claim 8 and wherein:

the vertically elongated compartments have at least three different sizes and shapes.

10. The invention as defined in claim 9 and wherein the vertically elongated compartments are arranged in at least three different rows.

11. The invention as defined in claim 1 and wherein the secondary storage compartment means comprises at least two rows of more than two vertically elongated compartments and each of the rows of vertically elongated compartments have compartments of the same size and shape.

12. The invention as defined in claim 11 and wherein there are at least two rows of horizontally elongated compartments.

13. The invention as defined in claim 12 and wherein:

one row of horizontally elongated compartments being located next adjacent the upper wall portion; and another one of said rows of horizontally elongated compartments being located next adjacent the lower wall portion.

14. A flexible travel bag for holding personal care items such as cosmetics and accessories while hanging in a vertical fully extended open position and in a closed folded carrying and storage position comprising:

a relatively large size main storage compartment means made of flexible foldable material and having a generally rectangular peripheral configuration and having a main flat outer side wall portion, an upper peripheral outer wall portion, a pair of spaced peripheral outer side wall portions and a bottom peripheral outer wall portion defining a main storage compartment;

a main compartment closure means mounted along said upper peripheral outer wall portion and along said spaced peripheral outer side wall portions of said main storage compartment means and along said bottom peripheral outer wall portion for closing said main storage compartment means in said closed, folded position wile enabling movement between said open position and said closed folded position;

hanger means mounted along said upper peripheral outer wall portion for hanging the bag in the vertical fully extended open position;

a plurality of relatively small size generally rectangular separate secondary storage compartment means mounted in said main storage compartment means for holding and storing a plurality of different types of relatively small size items, each secondary storage compartment means having a back wall portion, a front wall portion, a pair of laterally spaced closed side portions, a closed lower side portion and an opening on the upper side portion which faces upwardly to said vertical fully extended open position;

said secondary storage compartment means having a plurality of different sizes and shapes and being arranged in a plurality of vertically spaced rows extending laterally across said main flat side wall portion between said pair of spaced peripheral outer side wall portions;

cover means for selectively covering and uncovering the open upper side portion of said relatively small size secondary storage compartment means and being movable between an open access position and a closed position relative to said secondary storage compartment means;

handle-type carrying means for carrying said bag by hand in the folded carrying and storage position and being fixed to said main storage compartment means and being positioned and located along said upper peripheral outer wall portion in the folded carrying and storage position; and said secondary storage compartment means comprising:

a first uppermost row of at least two equal size and shape horizontally elongated compartments extending between said outer side wall portion;

a second row of more than two vertically elongated equal size and shape compartments located next below said first row and extending between said outer side wall portions;

a third row of more than two vertically elongated equal size and shape compartments located next below said second row at the mid-section of said bag and extending between said outer side wall portions;

a fourth row of two or more equal size and shape vertically elongated compartments located next below said third row and extending between said outer side wall portions; and an elongated bottom compartment located above said bottom outer wall portion and extending between said outer side wall portions.

15. The invention as defined in claim 14 and wherein said hanging means comprising:

strap means for engagement with a shower rod or hook.

16. The invention as defined in claim 14 and wherein said secondary storage compartment means comprising:

a main support sheet of plastic material fastened to said main flat outer side wall portion and having a length and width approximately equal to the length and width of said main flat outer side wall portion and forming said back wall portion of each of said secondary storage compartment means; and a plurality of separate sheets of plastic material fastened to said main support sheet of plastic material extending laterally thereacross and having a length equal to the width of said main support sheet of plastic material and a width equal to the height of said secondary storage compartment means and forming said front wall portion and said side portions and said lowerside portion of each of said secondary storage compartment means.

17. The invention as defined in claim 16 and further comprising:

another separate sheet of plastic material fastened to said main support sheet of plastic material and forming each of said cover means.

18. The invention as defined in claim 17 and further comprising:

fastening means associated with said cover means for fastening said cover means to said secondary storage compartment means.

* * * * *